US006984105B2

(12) United States Patent
Clark et al.

(10) Patent No.: US 6,984,105 B2
(45) Date of Patent: Jan. 10, 2006

(54) CONTROL OF VARIABLE STATOR VANES IN A GAS TURBINE ENGINE

(75) Inventors: Tom Clark, Bristol (GB); Gareth Holland, Preston (GB); Paul Mansi, Bristol (GB); Christopher Todd, Bristol (GB)

(73) Assignee: Rolls-Royce PLC, London (GB)

( * ) Notice: Subject to any disclaimer, the term of this patent is extended or adjusted under 35 U.S.C. 154(b) by 141 days.

(21) Appl. No.: 10/791,721

(22) Filed: Mar. 4, 2004

(65) Prior Publication Data

US 2004/0202537 A1 Oct. 14, 2004

(30) Foreign Application Priority Data

Apr. 12, 2003 (GB) ..... 0308472

(51) Int. Cl.
*F01D 17/16* (2006.01)

(52) U.S. Cl. ..... 415/160

(58) Field of Classification Search ..... 415/151, 415/159, 160, 161, 162, 163, 164, 165, 166
See application file for complete search history.

(56) References Cited

U.S. PATENT DOCUMENTS

| | | | | |
|---|---|---|---|---|
| 4,049,360 A | | 9/1977 | Snell | |
| 5,636,968 A | * | 6/1997 | Audet et al. | 415/160 |
| 6,019,574 A | | 2/2000 | DiBella | |

FOREIGN PATENT DOCUMENTS

| | | |
|---|---|---|
| FR | 2 784 711 | 4/2000 |

* cited by examiner

*Primary Examiner*—Christopher Verdier
(74) *Attorney, Agent, or Firm*—Oliff & Berridge, PLC

(57) ABSTRACT

Vane actuating apparatus for adjusting the angle of incidence of a set of variable angle vanes in a gas turbine engine comprises a plurality of vane actuator levers attached at one end to a respective vane and at the other end to an actuation arrangement for moving the vanes in unison. Each lever has an interlocking connection arrangement for pivotally connecting the lever with respect to its respective vane in such a way that the lever is capable of being attached and detached from the vane at a first angular position, and retained in interlocking engagement for pivotal movement at a second angular position or range of positions.

12 Claims, 2 Drawing Sheets

CONTROL OF VARIABLE STATOR VANES IN A GAS TURBINE ENGINE

This invention concerns improvements in or relating to the control of variable stator vanes and/or inlet guide vanes in a gas turbine engine. In particular the invention concerns improvements to vane actuating apparatus.

In a gas turbine engine having a multi-stage axial compressor the turbine rotor is turned at high speed so that air is continuously induced into the compressor, accelerated by the rotating blades and swept rearwards onto an adjacent row of stator vanes. Each rotor stator stage increases the pressure of the air passing through the stage and at the final stage of a multistage compressor the air pressure may be many times that of the inlet air pressure.

In addition to converting the kinetic energy of the air into pressure the stator vanes also serve to correct the deflection given to the air by the rotor blades and to present the air at the correct angle to the next stage of rotor blades.

As compressor pressure ratios have increased it has become more difficult to ensure that the compressor will operate efficiently over the operational speed range of the engine. This is because the inlet to exit area ratios of the stator vanes required for high pressure operation can result in aerodynamic inefficiency and flow separation at low operational speeds and pressures.

In applications where high pressure ratios are required from a single compressor spool the above problem is preferably overcome by using variable stator vanes. Variable stator vanes permit the angle of incidence of the exiting air onto the rotor blades to be corrected to angles which the rotor blades can tolerate without flow separation.

The use of variable inlet guide vanes and/or variable stator vanes permits the angle of one or more rows of stator vanes in a compressor to be adjusted, while the engine is running, in accordance with the rotational speed and mass flow of the compressor.

The term variable inlet guide vane (VIGV) used herein refers specifically to vanes in the row of variable vanes at the entry to a compressor. The term variable stator vane (VSV) used herein refers generally to the vanes in the one or more rows of variable vanes in the compressor which may include a VIGV row. The function of such VIGV's or VSV's is to improve the aerodynamic stability of the compressor when it is operating at relatively low rotational speeds at off-design, i.e. non-optimum speed, conditions.

At low speed and mass flow conditions, the variable vanes may be considered to be in a closed position, directing and turning the airflow in the direction of rotation of the rotor blades immediately downstream. This reduces the angle of incidence at entry to the blades and hence the tendency of them to stall. As the rotational speed and mass flow of the compressor increases with increasing engine power, the vanes are moved progressively and in unison towards what may be considered to be an "open" position.

The movement is controlled such that the flow angle of the air leaving the stator vanes continues to provide an acceptable angle of incidence at entry to the downstream row of rotor blades. When the vanes are in the fully "open" position, the angles of all of the stator vanes and rotor blades will typically match the aerodynamic condition at which the compressor has been designed i.e. its "design point". The terms "open" and "closed" used herein are to be construed according to the above definition.

For a VIGV or VSV arrangement to function effectively, it must be geometrically precise, such that the angular positions of the vanes in an individual row (or stage) may be controlled accurately, repeatably and in total unison. To achieve these requirements the vanes and actuating mechanism must be capable of moving freely with low friction.

In a typical arrangement each individual vane in a VIGV row is typically supported in two journal bearings at the radially inner and outer ends of the vane aerofoil section. In contrast, in a typical VSV row, the vanes are usually supported at their radially outer end only by a single journal bearing arrangement. The journal bearing arrangement permits the vane aerofoil to rotate or pivot about its spanwise axis. This axis is typically radial, or nearly radial, relative to the compressor or engine axis. The angular position of the vane is controlled by an actuating lever, which is attached to a spigot type extension at the radially outer journal end of the vane. The actuating lever of each vane in a row is connected to actuating means, typically comprising an actuation ring, also commonly referred to as a unison ring, which is concentric with the row of vanes which it acts upon, and rotates about the compressor's axis of rotation. The unison ring is moved by means of an actuator, which may be controlled by a signal from the engine fuel management and control system. As each vane is rotated between its "closed" and "open" position, the actuating lever follows an arc of a circle about the spanwise axis of rotation of the vane; in a plane that is substantially tangential to the cylindrical casing of the compressor. However, in moving each lever between its "closed" and "open" position, the nominal attachment point of the lever to the unison ring rotates in an arc about the compressor axis. The axes of the two arcs of movement are therefore substantially at right angles to one another. Consequently, without an additional degree of freedom, there would be a conflict of the locus of the end of the vane actuating lever and that of its attachment point to the unison ring. The provision of this additional degree of freedom has resulted in many different designs for VIGV and VSV actuating mechanisms.

In one arrangement the vane actuating levers are located in a spherical type bearing in the actuating ring and are pivotably connected to a vane attachment bracket by a pin to provide a hinge type arrangement. The hinge pin is retained by a split pin. This arrangement is relatively complex and the operation of fastening a split pin to each of the many pins is a time consuming repetitive and laborious task which can be subject to human error. In addition, the split pin can become disconnected due to engine vibration.

There is a requirement therefore for a vane actuating arrangement that provides the necessary degrees of freedom between the actuator ring and the vane without the mechanical complexity and assembly constraints of hitherto known arrangements.

According to an aspect of the invention there is provided a vane actuating apparatus for adjusting the angle of incidence of a set of variable angle vanes in a gas turbine engine; the apparatus comprising a plurality of vane actuator levers attached at one end to a respective vane and at the other end to actuation means for moving the vanes in unison about their respective pivot axis, each lever having an interlocking connection means for pivotally connecting the lever with respect to its respective vane in such a way that the lever is capable of being attachably/detachably mounted with respect to the vane at a first angular position and retained in interlocking engagement for pivotal movement with respect to the vane at a second angular position or range of positions.

The connection means preferably comprises a hinge including a hinge pin and a socket for receiving the hinge pin.

In preferred embodiments the hinge pin is fixed with respect to the lever and the socket is fixed with respect to the vane. In another embodiment the hinge pin may be fixed with respect to the lever and the socket fixed with respect to the vane Preferably, the socket is open on one side for receiving or releasing the hinge pin along an insertion direction perpendicular to the hinge axis.

The width dimension of the hinge pin preferably varies across the hinge axis so that the pin may be released and received only when the lever is in the said first angular position.

The hinge pin may comprises a pair of parallel flat surfaces on opposites sides of the pin diameter such that the width dimension of the pin between the flat surfaces is less than the pin diameter and substantially the same as the open end of the socket through which it is released and received.

In a preferred embodiment the socket comprises a generally U-shaped bracket having a pair of open ends which receive opposite ends of the said pin.

According to another aspect of the invention there is provided a vane actuating lever for adjusting the angle of incidence of a variable angle stator vane in a gas turbine engine; the lever comprising a first end for attachment to a respective stator vane and a second end for attachment to a vane actuator ring, the lever having at least one integral hinge pin for pivotally connecting the lever with respect to its respective vane in such a way that the lever is capable of being attachably/detachably mounted with respect to the vane at a first angular position and retained in interlocking engagement for pivotal movement with respect to the vane at a second angular position or range of positions.

Various embodiments will now be more particularly described, by way of example only, with reference to the accompanying drawings, in which.

Figure 1:
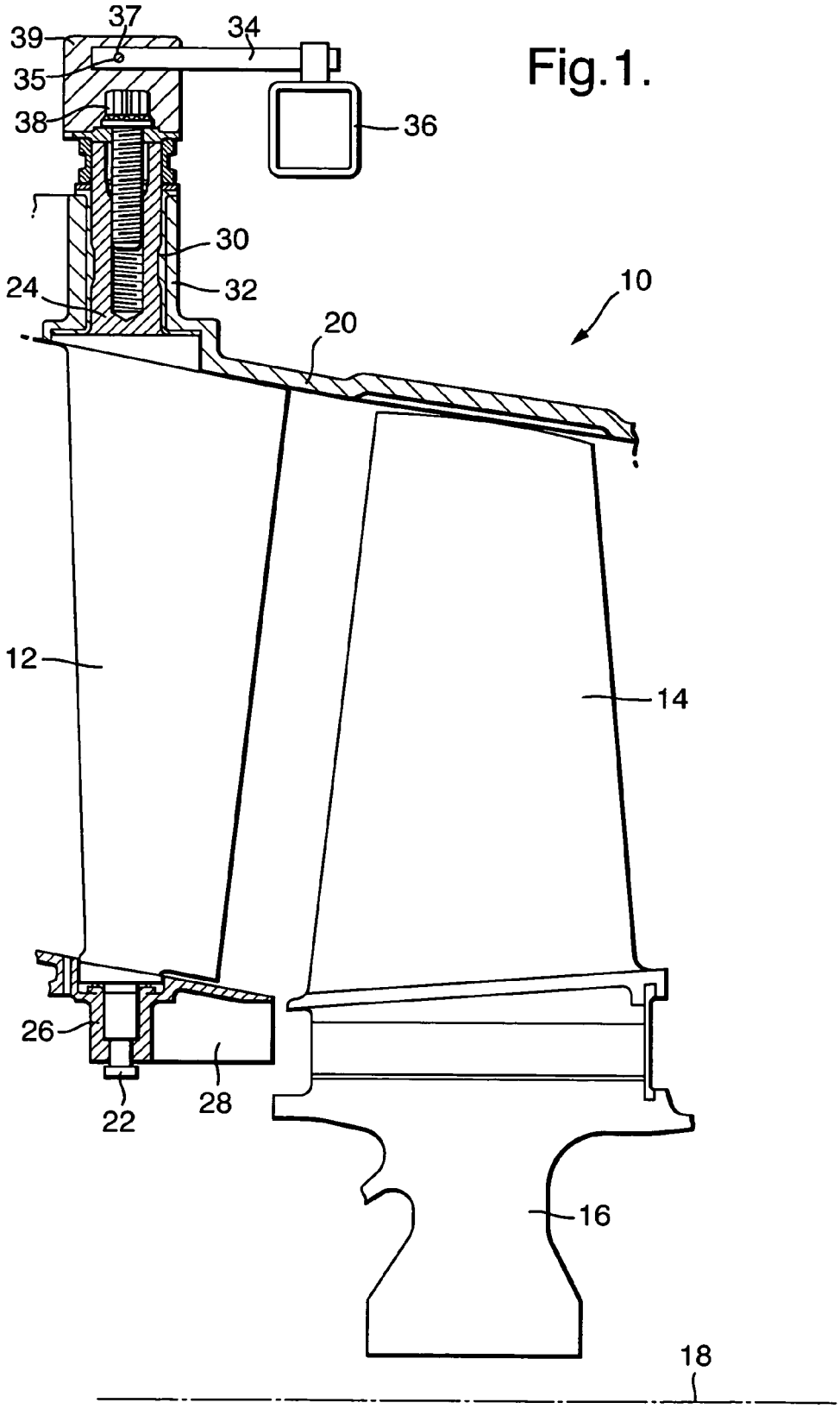
FIG. 1 is an axi-symmetric cross-section view of a gas turbine engine compressor stage having a row of variable inlet guide means with a vane actuating arrangement.

Referring to FIG. 1, an axial flow compressor stage 10, which is part of a multistage axial flow compressor in a gas turbine engine, comprises a row of circumferentially spaced variable guide vanes 12 positioned upstream (to the left of the drawing in FIG. 1) of a row of circumferentially spaced rotor blades 14. The rotor blades 14 are attached to the rim of a rotor disc 16 which is constrained to rotate about the compressor and engine axis 18 within a compressor casing 20 which surrounds the tips of the rotor blades 14. The stator vanes 12 are pivotally mounted with respect to the casing 20 by radially inner and outer radially extending spigots 22 and 24 which extend at the respective radially inner and outer spanwise ends of the vanes. The inner spigot 22 is rotatably mounted within a journal bearing 26 which is fixed to surrounding engine bearing support structure 28. The radially outer spigot is rotatably mounted within a journal bearing 30 provided within a radially extending boss 32 on the outer side of the compressor casing 20. The spigot 24 is connected to a vane actuating ring 36 which extends coaxially about the engine axis 18 on the outside of the casing 20. The spigot 24 is connected to the actuating ring 26 by means of a lever arm 34 which is secured to the spigot by means of a hinge pin 37, a forked connection bracket 39 and a fastening bolt 38. The connection bracket 39 has a generally U-shaped cross-section in the plane perpendicular to the drawing of FIG. 1. The hinge pin is received in mounting apertures 35 in the parallel side plates of the bracket so that the lever is capable of pivoting about the hinge axis.

The radially inner and outer spigots 22 and 24 are aligned so that they define a spanwise axis of rotation about which the vanes 12 pivot when the actuator ring 36 is rotated about the engine axis 18.

The actuator ring 36 is connected to each of the vanes 12 in the same way so that rotation of the ring 36 causes the vanes to pivot about their respective axis together.

Figure 2:
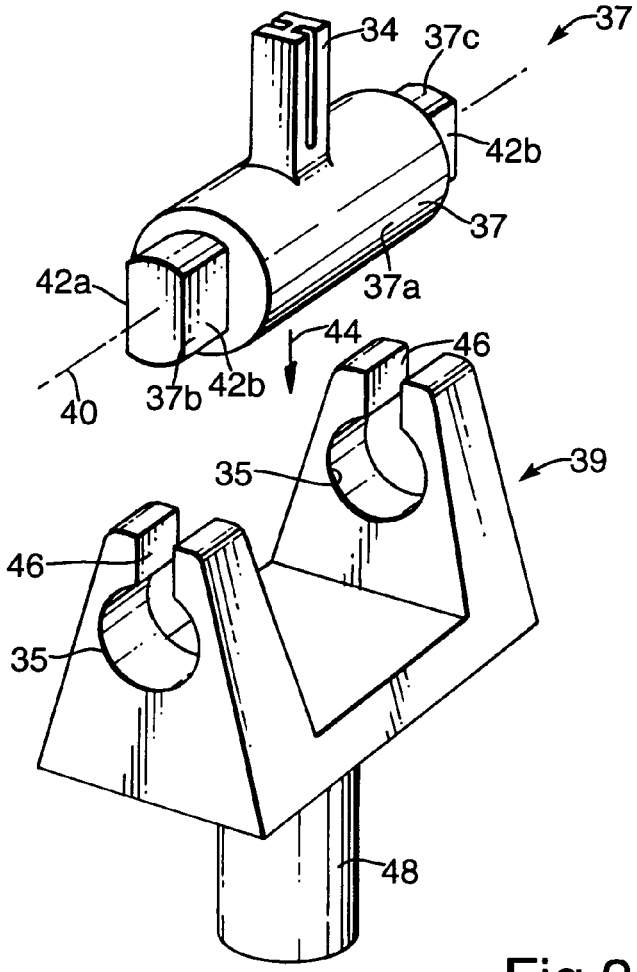
FIG. 2 is a detailed perspective view of part of a vane actuating arrangement according to an embodiment of the present invention.

In the arrangement of FIG. 2 the lever 34 is integrally formed with a hinge pin type connection 37 at its end where it is connected to the U-shaped bracket 39. The hinge axis 40 extends perpendicular to the elongate axis of the lever 34 and comprises a central section 37*a* of generally cylindrical circular cross section configuration and a pair of hinge pin protrusions 37*b*, 37*c* which extend in the longitudinal direction of the pin on either side of the central section 37*a*. The protrusions 37*b*, 37*c* have a reduced diameter cross section compared with the central section 37*a*. Each of the protrusions 37*b*, 37*c* comprises a pair of parallel flat surfaces 42*a*, 42*b* on opposite sides of the circumference thereof such that the width dimension of the protrusion between the flat surfaces is less than the diameter of the protrusions as determined by the circumference of the protrusions between the flat parallel sides.

The U-shaped connection bracket 39 includes circular apertures 35 in the sides, or parallel, of the bracket. The apertures have substantially the same diameter as that of the protrusions 37*b*, 37*c* such that the hinge pin 37 is rotatable about its axis 40 when located in the apertures 35. The apertures 35 are open on their side nearest the tip of the U-shaped bracket for receiving or releasing the hinge pin along an insertion direction perpendicular to the hinge axis, as indicated by arrow 44 in the drawing of FIG. 2. The width dimension of the protrusions between the flat surfaces 42*a*, 42*b* is substantially the same, or slightly less than, the width dimension of the open slots 46 which extend between the tips of the sides of the U-shaped bracket and the circular apertures 35. The slots 46 and apertures 35 thus define a socket for receiving the hinge pin 37.

Figure 3:
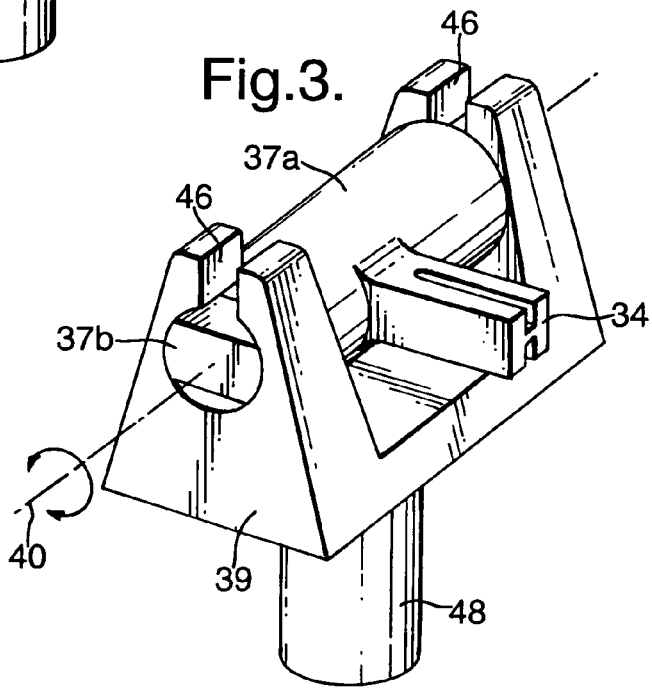
FIG. 3 is a perspective view similar to that of FIG. 2 with the components of FIG. 2 shown in an assembled state.

The pin 37 and bracket 39 constitute an interlocking connection means at the end of the lever remote from the actuating ring for pivotally connecting the lever with respect to its vane in such a way that the lever is capable of being attachably/detachably mounted with respect to the vane at a first angular position, as shown in the drawing of FIG. 2, and retained in interlocking engagement for pivotal movement with respect to the vane at a second angular position or range of positions, as shown in the drawing of FIG. 3. In this way the integral hinge and lever is retained within the apertures 35 of the bracket 39 in all angular positions during operation, while being received or released through the slots 46 only when the lever is rotated about the axis 40 so that flat parallel surfaces 42*a*, 42*b* are aligned with the sides of the slots 46.

In the assembled configuration of FIG. 3 the lever 34 extends substantially perpendicularly to the direction of the slots 46 such that the flat parallel surfaces 42 lie substantially perpendicular to the slots 46. In this position the integral lever and hinge is retained in the apertures 35 for pivotal movement with respect to the bracket about the hinge axis 40. In use, the degree of pivoting of the lever 34 about the hinge axis 40 is relatively small, for example 2° or so, and therefore the integral lever and hinge pin is retained in interlocking engagement with respect to the vane throughout its operational range of movement.

As can be seen in the drawings of FIGS. 2 and 3 the connection bracket 39 is provided with a vane connecting spigot 48 which extends on the underside of the U-shaped bracket for connecting the bracket to the radially outer spigot 24 of the vane. The connector 48 may comprise a splined coupling or other engagement means for fixing the bracket to the vane for rotation with the vane about its spanwise axis.

Although aspects of the invention have been described with reference to the embodiments shown in the accompanying drawings, it is to be understood that the invention is not limited to those precise embodiments and that various changes and modifications may be effected without further inventive skill and effort.

What is claimed is:

1. Vane actuating apparatus for adjusting the angle of incidence of a set of variable angle vanes in a gas turbine engine; the apparatus comprising a plurality of vane actuator levers attached at one end to a respective vane and at the other end to actuation means for moving the vanes in unison about their respective pivot axis, each lever having an interlocking connection means for pivotally connecting the lever with respect to its respective vane in such a way that the lever is capable of being attachably/detachably mounted with respect to the vane at a first angular position and retained in interlocking engagement for pivotal movement with respect to the vane at a second angular position or range of positions.

2. Apparatus as claimed in claim 1 wherein the said connection means comprises a hinge including a hinge pin and a socket for receiving the hinge pin.

3. Apparatus as claimed in claim 2 wherein the hinge pin is fixed with respect to the lever and the socket is fixed with respect to the vane.

4. Apparatus as claimed in claim 3 wherein the socket is open on one side for receiving or releasing the hinge pin along an insertion direction perpendicular to the hinge axis.

5. Apparatus as claimed in claim 4 wherein the width dimension of the hinge pin varies across the hinge axis so that the pin may be released and received only when the lever is in said first angular position.

6. Apparatus as claimed in claim 5 wherein the hinge pin comprises a pair of parallel flat surfaces on opposites sides of the pin circumference such that the width dimension of the pin between the flat surfaces is less that the pin diameter and substantially the same as the open end of the socket through which it is released and received.

7. Apparatus as claimed in claim 2 wherein the socket comprises a generally U-shaped bracket having a pair of open ends which receive opposite ends of the hinge pin.

8. Apparatus as claimed in claim 3 wherein the socket comprises a generally U-shaped bracket having a pair of open ends which receive opposite ends of the hinge pin.

9. Apparatus as claimed in claim 4 wherein the socket comprises a generally U-shaped bracket having a pair of open ends which receive opposite ends of the hinge pin.

10. Apparatus as claimed in claim 5 wherein the socket comprises a generally U-shaped bracket having a pair of open ends which receive opposite ends of the hinge pin.

11. Apparatus as claimed in claim 6 wherein the socket comprises a generally U-shaped bracket having a pair of open ends which receive opposite ends of the hinge pin.

12. A vane actuating lever for adjusting the angle of incidence of a variable angle stator vane in a gas turbine engine; the lever comprising a first end for attachment to a respective stator vane and a second end for attachment to a vane actuator ring, the lever having at least one integral hinge pin for pivotally connecting the lever with respect to its respective vane in such a way that the lever is capable of being attachably/detachably mounted with respect to the vane at a first angular position and retained in interlocking engagement for pivotal movement with respect to the vane at a second angular position or range of positions.

* * * * *